United States Patent [19]

Kerby et al.

[11] 4,416,746

[45] Nov. 22, 1983

[54] BIPOLAR REFINING OF LEAD

[75] Inventors: Robert C. Kerby, Rossland; Clifford J. Krauss, Trail, both of Canada

[73] Assignee: Cominco Ltd., Canada

[21] Appl. No.: 338,654

[22] Filed: Jan. 11, 1982

[30] Foreign Application Priority Data

Feb. 12, 1981 [CA] Canada ..... 370752

[51] Int. Cl.[3] ..... C25C 1/18

[52] U.S. Cl. ..... 204/114

[58] Field of Search ..... 204/117, 114, DIG. 9

[56] References Cited

U.S. PATENT DOCUMENTS 4,177,117 12/1979 Kerby ..... 204/114

4,282,075 8/1981 Baggio et al. ..... 204/117 X

FOREIGN PATENT DOCUMENTS 928246 6/1973 Canada ..... 204/114

*Primary Examiner*—G. L. Kaplan

*Assistant Examiner*—Nam X. Nguyen

*Attorney, Agent, or Firm*—Wenderoth, Lind & Ponack

[57] ABSTRACT

Improvements in the bipolar refining of lead are described, comprising maintaining a high current density controlled at a value such that the anode overvoltage will not exceed the value at which impurities dissolve and which is related to the internal resistance of the cell, together with periodic reversal of the polarity of the current applied to the electrodes. These improvements result in improved cell efficiency and in the formation of strong, coherent lead deposits which are easily stripped by mechanical means.

4 Claims, No Drawings

BIPOLAR REFINING OF LEAD

BACKGROUND OF THE INVENTION (a) Field of the Invention

This invention relates to improvements in the process for the bipolar refining of lead and, more particularly, to a method for improving the efficiency of the process.

(b) Description of the Prior Art

In bipolar refining of lead, a number of lead bullion electrodes are immersed in an electrolytic cell containing a lead fluosilicate-fluosilicic acid electrolyte. Only the first and last electrodes in the cell are connected to a source of direct electrical current, the remainder of the electrodes being left unconnected to the current source. The current causes lead to dissolve from the lead bullion electrodes leaving a layer of slimes containing impurities such as, for example, bismuth, arsenic and antimony, adhering to the anodic side of the electrodes, and causes dissolved lead to deposit as refined lead on the cathodic side of the electrodes. Upon completion of the refining cycle, electrodes are removed from the cell and slimes and refined lead are stripped from the electrodes. The efficiency of this process is high and is much improved over that of the conventional Betts Process. Supply of electrical power to cell and electrodes is vastly simplified, current densities can be much higher and mechanization is possible to a much greater degree than with the Betts Process. The process for the bipolar refining of lead is described in detail in our U.S. Pat. No. 4,177,117, which issued Dec. 4, 1979.

Although the bipolar refining process has many advantages over the Betts Process, control of the process has been found to be difficult when the process is operated at high current densities. Maintaining the desired low impurity content of the refined lead becomes more difficult with increasing current densities, in spite of operating at the optimum current-voltage relationship to prevent the anode overvoltage from exceeding the voltage at which impurities dissolve from the lead bullion. In addition, at high current densities the layer of slimes which remains adhering to the anodic side of the bipolar electrodes becomes less stable. Detachment of the slimes from the anodic side of the bipolar electrodes results in an increasing amount of slimes in the electrolyte and of impurities in the refined lead. The control of electrical shorting in the cell becomes more difficult, particularly because higher than average current densities at the edges of the electrodes tend to result in undesirable nodular and dendritic growths. Because it is also desirable to maintain close spacings between the electrodes and the cell walls, such growths may also occur across the gap between electrodes and cell walls. Electrical shorting also occurs at a higher incidence at the end electrodes than at the other electrodes in the cell. Electrical shorting can only be partly controlled by monitoring the cathode polarization voltage and maintaining optimum amounts of addition agents in the electrolyte. The lead deposited at high current densities tends to become coarser, less dense and more brittle which results in difficulties when the refined lead is to be stripped from the electrodes.

SUMMARY OF THE INVENTION

We have now discovered that the control of the bipolar refining process can be improved when a number of interdependent process parameters are carefully regulated. More specifically, we have now discovered that, when operating at high current densities, the impurity content of the refined lead and the stability of the slimes layer can be considerably improved, and the electrical shorting and undesirable lead growths can be substantially alleviated by adjusting the composition of the electrolyte and adjusting the spacing between electrodes in conjunction with operating the process with a programmed current within defined limits and in conjunction with applying periodic current reversal.

The use of programmed current has been disclosed in the above named U.S. Pat. No. 4,177,117 and is carried out according to a procedure described in more detail, in the context of the conventional Betts Process, in out Canadian Pat. No. 1,020,491 issued Nov. 8, 1977.

In accordance with this procedure, the anode overvoltage may be established at the beginning of the refining process at a value just below the critical value at which impurities dissolve and the current is increased to its maximum value allowable in relation to the cell resistance. The current is gradually decreased from its initial maximum allowable value to allow, at all times, for the effects of the increasing thickness, and hence increasing resistance, of the slimes layer, thereby to ensure that the critical value for the anode overvoltage at which impurities dissolve is not exceeded. The process may be operated at a constant value for the anode overvoltage of about but not exceeding the value of the voltage at which impurities, especially bismuth, dissolve by controlling the current which passes through the cells at maximum allowable decreasing values. This results in a reduction of the duration of the refining process to it minimum value. The process may also be operated with a cell potential giving anode overvoltage values further below the critical value, allowing the anode overvoltage to increase to its critical value during electrolysis and with currents at values below the maximum values allowable. This results in a proportional increase in the duration of the refining process. Thus, while the number of Ampere-hours remains constant for the deposition of a given amount of lead, the duration of the refining process varies correspondingly to the electrical current applied to the cell.

The use of periodic current reversal in electrodeposition of lead has been disclosed. According to U.S. Pat. No. 2,451,340, which issued Oct. 12, 1948, to Westinghouse Electric Corporation, a plating current is applied in the electroplating of metals for a period of 40 seconds or less to electroplate an initial layer, then deplating current is applied for a period of 20 seconds or less to deplate a substantial amount of the plated metal. The alternating plating and deplating steps are then continued as desired. The deplating current is applied for a time sufficient to deliver from 1/20 to $\frac{1}{2}$ of the Coulombs delivered during the plating period; thus from 5% to 50% of the plated metal is deplated during the period of reversed current.

This patent is directed to the electroplating of a number of metals including lead but is silent on processes for the refining of lead. Application of deplating current equivalent to 1/20 to $\frac{1}{2}$ of the Coulombs delivered during the plating period, which would remove from 5 to 50% of the deposited metal, would give losses in current efficiency in the bipolar electrorefining process which are totally unacceptable in commercial practise.

According to Canadian Pat. No. 928,246, which issued June 12, 1973, there is disclosed a process for the electrorefining of lead from a hydrofluosilicic acid or sulfamic acid electrolyte. The electro deposition of lead is effected while applying a reversible current for a duration of reversed polarity of 2 to 8% of the total period of passing current, and with a frequency of from 2 to 8 reversals of the current per minute. Electrolysis may be carried out at current densities in the range of 100 to 600 A/m$^2$, at temperatures in the range of 25° C. to 45° C. using an electrolyte containing 50 to 120 g/L lead, 70 to 150 g/L free fluosilicic acid and addition agents, and using a refining cycle ranging from 48 to 144 hours.

The process according to this patent is silent on the bipolar refining of lead and a number of disadvantages. Using 2 to 8% reversal of current, a loss of current efficiency of from 4 to 16% results. More serious is the fact that the process cannot be operated at current densities above about 300 A/m$^2$ for the lowest disclosed period of the refining cycle of 48 hours, unless programmed current is used to prevent exceeding the critical value of the anode overvoltage. There is no indication that the recited cycle time is of any significance and the patent is silent as to how the overvoltage problem is to be overcome. Thus, operating for 48 hours above 300 A/m$^2$ will cause the slimes layer to become unstable and impurities to dissolve and contaminate the refined lead. At current densities above 300 A/m$^2$, the refining cycle must be shorter than 48 hours and, conversely, with refining cycles longer than 48 hours the current densities must be lower than 280 A/m$^2$. Both situations are in accordance with the changing current-voltage relationship during the refining cycle as a result of the increasing resistance of the slimes layer on the electrodes.

Although the use of high lead and high acid contents in the electrolyte are disclosed, the disclosure is silent on the necessity of using low acid concentrations when high lead concentrations are used in the electrolyte. It has, moreover, not been appreciated that high lead concentrations in the electrolyte are necessary when the refining process is operated at high current densities.

The present invention seeks to operate the bipolar process for the refining of lead at high current densities with current supplied to the process in a programmed fashion.

The present invention further seeks to operate the bipolar process for the refining of lead at high current densities and whilst maintaining a stable layer of slimes adhering to the anodic surfaces of the electrodes.

Additionally, this invention seeks to control undesirable growths of lead on the electrodes in the cell, and to reduce the occurrence of electrical shorting.

In a further aspect this invention seeks to produce strong, coherent and easily strippable lead deposits on the electrodes.

DESCRIPTION OF THE PREFERRED EMBODIMENTS

Accordingly, there is provided a process for controlling the bipolr refining of lead in an electrolytic cell containing impure lead bullion electrodes, and an electrolyte containing lead fluosilicate, fluosilicic acid and addition agents which process comprises in combination the steps of:

(a) applying a current across the end electrodes at the beginning of the refining cycle at a value, expressed as current density, in the range of about 240 to 450 A/m$^2$;

(b) maintaining the anode overvoltage at a value not exceeding the voltage at which impurities dissolve from the anodic slimes and maintaining the electrical current at the maximum value possible related to the change of the internal resistance of the cell which will not cause the anode overvoltage to rise above the voltage at which impurities dissolve, whereby the slimes remain adhering to the electrodes;

(c) reversing the polarity of the current applied to the electrodes at a frequency chosen in the range of about 4 to 60 reversals per minute with a duration of each reversal chosen in the range of about 40 to 300 milliseconds such that the total period of reversal of polarity of the current is in the range of about 1% to about 4.5% of the period during which current is applied to the electrodes; and (d) recovering refined lead.

Preferably, the current is periodically reversed with a frequency chosen in the range of about 4 to about 20 reversals per minute, with a duration of each reversal chosen in the range of about 150 to about 300 milliseconds such that the total period of reversal of polarity is in the range of about 3% to about 4.5%. Preferably, the electrolyte contains at least about 85 g/L lead as lead fluosilicate and not more than about 85 g/L free fluosilicic acid, more preferably about 85 to about 120 g/L lead, and about 50 to about 85 g/L fluosilicic acid, most preferably 60 to 70 g/L fluosilicic acid. Preferably, the initial current expressed as current density at the electrodes is in the range of about 260 to about 400 A/m$^2$. Preferably, the value of the anode overvoltage is about but does not exceed 200 mV. Preferably, the current is applied for a period of time in the range of about 72 to about 130 hours, most preferably about 84 to about 120 hours. Preferably, the spacing of the end electrodes from their immediate neighbouring electrodes is increased by a distance in the range of about 1.5 to about 3 times the spacing between the other electrodes in the cell.

By using this method of control for the refining process, refined lead is recovered which has a bismuth content of about 10 parts per million or less; bismuth is the most important of the possible soluble impurities in the anodic slimes.

For obtaining the highest productivity, the refining process should be operated at the highest possible current density and shortest possible refining cycle, while maintaining the highest possible current efficiency and obtaining a high quality refined lead. When operating the bipolar refining process, the critical value of the anode overvoltage, i.e., the value at which impurities, especially bismuth, dissolve from the electrodes, must not be exceeded. When the critical value is exceeded, even for a short period, not only do impurities dissolve, but the layer of slimes remaining on the electrodes becomes unstable and slimes separate. Separated slimes contaminate the electrolyte, form a base for the occurrence of electrical shorting, and complicate any electrolyte purification procedure.

When current is applied to the electrolytic cell in a programmed manner, the length of the refining cycle can be decreased. The values of the current, or current density, during the refining cycle are at the maximum allowable decreasing values related to the change of the internal resistance of the cell. The anode overvoltage is at a value close to but not exceeding the critical value. However, because higher inter-electrode voltages result from the higher initial values of the current, the power consumption per tonne of lead and, therefore, the operating costs of the process increase. Consequently, there exist a set of optimum values for the current that is initially applied to the electrodes and for the length of the refining cycle.

We have found that values for the current initially applied to the electrodes at the beginning of the refining cycle, expressed as current density at the electrodes, are in the range of about 240 to about 450 $A/m^2$, preferably in the range of about 260 to about 400 $A/m^2$. Corresponding values for the duration of the refining cycle are in the range of about 72 to about 130 hours, preferably, in the range of about 84 to about 120 hours. Above an initial current, expressed as current density, of 450 $A/m^2$ the gain in productivity does not warrant the additional requirements to make it possible to increase the current. During the refining cycle, the current is automatically reduced by use of a programmer. The programmer maintains the current at maximum allowable values, maintains the value of the anode overvoltage at about but not exceeding its critical value and reduces the current to the electrodes in response to the increasing resistance of the slimes layer. At the end of the refining cycle the current, expressed as current density at the electrodes, generally has values in the range of about 200 to about 220 $A/m^2$. Using the programmed current, the stability of the slimes is excellent and the impurity content of the refined lead is low.

Using an electrolyte with the conventionally used composition of about 60 g/L lead as lead fluosilicate and about 90 g/L free fluosilicic acid gave unsatisfactory lead deposits when operating at current densities over 240 $A/m^2$. The lead deposits were brittle, of low ductility and of relatively low density. This resulted in difficulties during the stripping of the deposits from the residual electrodes.

We have found quite unexpectedly that the bipolar refining process the quality of the lead deposit is related to the composition of the electrolyte. Thus, we have discovered that when the bipolar refining process is operated at high current densities, the lead content of the electrolyte must be increased and the free acid content decreases in order to produce dense and strong lead deposits which can be readily stripped. Dense and strong lead deposits are obtained when the electrolyte contains at least about 85 g/L lead as lead fluosilicate and not more than about 85 g/L free fluosilicic acid. Preferably, the lead concentration is maintained in the range of about 85 to about 120 g/L lead and the acid concentration in the range of about 50 to about 85 g/L. Above about 120 g/L lead, significant reductions in the current supplied to the electrodes are necessary to avoid exceeding the critical value of the anode overvoltage. Below about 50 g/L free fluosilicic acid, the conductivity of the electrolyte becomes too low, resulting in high energy losses. The most preferred range of the acid concentration is about 60 to about 70 g/L.

The high current and the use of direct current, programmed at maximum allowable values, however results in a refined lead which is relatively high in impurities, especially bismuth. To lower the bismuth content of the refined lead, the current must be programmed at values about 10 to 20% below the maximum allowable values. This means that a proportionally longer refining cycle is required to obtain the same production.

The high current densities in the process, in combination with the high lead concentrations in the electrolyte, also cause uneven deposits of lead, as well as thicker deposits of lead at the edges of the bipolar electrodes, especially at the end electrodes. Dendritic growth of lead, especially across any slimes, cell walls, etc., has a greater incidence of occurrence. These generally uneven deposits and growths of lead cause increased shorting in the cell with a resulting reduction in efficiency.

We have found that, when the polarity of the current to the electrodes is periodically reversed for short periods during the refining cycle, these difficulties can be effectively overcome. In addition, bismuth content of the refined lead is reduced and the current can be programmed at maximum allowable values. Thus, with current reversal, the refining cycle can be shortened and refined lead is produced with a very low bismuth content.

In current reversal, the frequency of the reversals and the duration of each reversal determine the total period of reversed polarity, usually expressed as a percentage of the duration of the refining cycle. Percentage reversal should be as low as possible in view of the adverse effect of periodically reversed current on the current efficiency. We prefer to operate the process with a reversed polarity of the current in the range of about 1% to about 4.5% of the total period during which current is applied. We have found that a current reversal of at least 1% is necessary to lower the bismuth content of the refined lead, when operating at high current densities. At a current reversal of above about 3%, the undesirable growths at the electrodes and in the cell are satisfactorily controlled, and even deposits of lead are obtained. Current reversal above about 4.5% has little additional beneficial effect. The frequency of reversals is chosen in the range of about 4 to 60 reversals per minute and the duration of each reversal is chosen in the range of about 40 to about 300 milliseconds, such that the period of reversed current is in the range of about 1% to 4.5% of the duration of the refining cycle. (For example, a frequency of 8 reversals per minute at a duration of 300 ms per reversal gives a reversal of 4%, a frequency of 60 at 40 ms gives a reversal of 4%, a frequency of 8 at 75 ms gives a reversal of 1%, etc.). To control the undesirable growths of lead and to alleviate the occurrence of electrical shorting we prefer to operate at a low frequency and long duration of each reversal, i.e., a frequency chosen in the range of about 4 to 20 reversals per minute with a duration chosen in the range of about 150 to about 300 ms per reversal, such that the reversal of current is in the range of about 3% to about 4.5%.

We have further found that edge growths are greater at the end electrodes which leads to increased incidence of electrical shorting between the end electrodes and their neighbouring electrodes in the cell. This higher incidence of shorting at the end electrodes can be overcome by increasing the spacing of the end electrodes from their respective neighbouring electrodes by a distance in the range of about 1.5 to 3 times the spacing between the other electrodes in the cell.

The advantage of the process according to the invention are many. The use of an electrolyte with an increased lead concentration and decreased free acid concentration make it possible to produce a dense, strong, easily strippable lead deposit and to operate with high current densities to increase productivity. The use of programmed current makes it also possible to operate at the desirable high average current densities with high initial currents. The refining cycle can be shortened and productivity increased. The layer of slimes is stable and impurity content of refined lead is low. Periodic current reversal effects further control of impurities in the refined lead, produces an even lead deposit, considerably reduces shorting in the cell and considerably reduces uneven nodular and dendritic growths of deposited lead in the cell. Shorting at the end electrodes is substantially eliminated by increasing the spacing of the end electrodes from their neighbouring electrodes.

The invention will now be illustrated by means of the following non-limitative examples.

EXAMPLE 1

In a series of tests, lead bullion electrodes containing such impurities as bismuth, silver, arsenic and antimony were subjected to bipolar refining in a small cell using electrolyte containing varying amounts of lead fluosilicate and fluosilicic acid. An initial current giving an electrode current density of 390 A/m$^2$ was applied to the electrodes. The anodic overvoltage was maintained constant at a value just below 200 mV. The initial current was decreased at maximum allowable values during the refining cycle to account for the increasing resistance, such that the value of the anodic overvoltage did not exceed 200 mV at any time during the refining cycle. After 96 hours the refining cycle was completed, the electrodes were removed from the cell and the lead deposits separated from the remaining lead bullion. The average ductility of the refined lead was determined by bending each lead deposit and noting the degrees bending at which the deposit cracked. Lead deposits with a ductility of less than about 20 degrees are generally too brittle for satisfactory stripping. The results are given in Table I.

TABLE I

| Electrolyte Composition | | |
|---|---|---|
| Pb in g/L | $H_2SiF_6$ in g/L | Average Ductility in Degrees |
| 55 | 50 | 5 |
| 65 | 85 | 15 |
| 75 | 90 | 15 |
| 85 | 115 | 10 |
| 90 | 75 | 40 |
| 110 | 50 | 20 |
| 115 | 80 | 20 |
| 135 | 55 | 180 |
| 135 | 70 | 180 |
| 210 | 55 | 180 |

The figures shown in Table I indicate the electrolyte containing 85 g/L lead or more and 50 to 85 g/L fluosilicic acid gave satisfactory deposits.

EXAMPLE 2

The tests described in Example 1 were repeated in a commercial size cell using different current densities.

The first test was run at a constant, conventional current density of 220 A/m$^2$, without the current being programmed. The refining cycle was terminated after 184 hours when the anode overvoltage reached 0.2 V. In the other tests, the current was automatically programmed from current densities of 390 and 500 A/m$^2$ at the beginning of the tests to 220 A/m$^2$ at the end of the tests. The length of each refining cycle was recorded. The number of electrical shorts occurring in the cell during each test was recorded. The average ductility of the lead deposits in each of the tests was determined as in Example 1. The results are given in Table II.

TABLE II

| Current Density in A/m$^2$ | Electrolyte Composition Pb (g/l) | Electrolyte Composition $H_2SiF_6$ (g/l) | Average Ductility in degrees | Number of shorts | Length of refining cycle in hours |
|---|---|---|---|---|---|
| 220* | 70 | 85 | 180 | 0 | 184 |
| 390 | 90 | 80 | 22 | 10 | 96 |
| 390 | 95 | 75 | 27 | 6 | 97 |
| 390 | 100 | 80 | 69 | 10 | 96 |
| 390 | 100 | 70 | 125 | 0 | 95 |
| 390 | 120 | 70 | 158 | 3 | 93 |
| 500 | 55 | 95 | 5 | 8 | 110 |
| 500 | 70 | 85 | 2 | 3 | 110 |
| 500 | 85 | 85 | 25 | 3 | 96 |
| 500 | 170 | 60 | 165 | 10 | 110 |

*conventional

The results in Table II clearly show that the refining process can be operated at high current densities with a 4 to 4½ day refining cycle. Ductile, dense and level lead deposits, which can be easily stripped, are obtained when the electrolyte contains 85 g/L lead fluosilicate or more and 85 g/L fluosilicic acid or less. The best lead deposits were obtained when the acid concentrations were from 60 to 70 g/L. The results also show that a number of electrical shorts occur in the cell.

EXAMPLE 3

This example shows that electrical shorting that occurs in a bipolar refining cell can be substantially reduced or even eliminated when the current is periodically reversed for short periods during the refining cycle, and the end electrodes are positioned at increased spacing from their immediate neighbouring electrodes.

23 lead bullion electrodes were placed in a cell through which electrolyte, containing 100 g/L lead as lead fluosilicate and 70 g/L fluosilicic acid and conventional addition agents, was circulated. The first and the last electrodes in the cell were spaced from their neighbouring electrodes at three times the spacing between the other electrodes. The electrolyte temperature was maintained at 35 degrees C. A current equivalent to a current density of 390 A/m$^2$ was applied and the current was programmed during the refining cycle to reach 220 A/m$^2$ at the end of the refining cycle. The anode overvoltage was maintained at just below 200 mV. The calculated current efficiency was 82% determined from the relationship between current efficiency and the ratio between electrode area and cross-sectional area of the cell. The refining cycle was 94 hours. The applied current was periodically reversed during the refining cycle and the number of electrical shorts occurring in the cell was recorded. The results of the tests are given in Table III.

TABLE III

| Periodic current reversal in % | Actual current efficiency in % | Number of electrical shorts during refining cycle |
|---|---|---|
| 0 | 72 | 7 |
| 0.1 | 72 | 14 |
| 1.0 | 78 | 3 |
| 1.2 | 82 | 1 |
| 3.0 | 82 | 1 |
| 4.5 | 82 | 0 |
| 6.0 | 82 | 0 |
| 12.5 | 82 | 0 |

The results given in Table III show that the current efficiency is adversely affected by shorting and that reversed current for periods of greater than about 3% of the refining cycle together with increased spacing of the end electrodes substantially eliminates the occurrence of electrical shorts.

EXAMPLE 4

This example illustrates that the amount of bismuth in refined lead can be controlled at less than 10 ppm when at least 1% current reversal is used and that control is improved when the duration of each reversal is 150 ms or more and the frequency of reversal is in the range of 4 to 60 reversals per minute.

A series of tests were done using the same apparatus and operating conditions as in Example 3. For each test, the bismuth content of the refined lead wad determined and the number of electrical shorts was noted. The results given in Table IV.

TABLE IV

| periodic current reversal in % | duration per reversal in ms | number of reversals per min | Bi in refined Pb in ppm | number of shorts | actual current efficiency in % |
|---|---|---|---|---|---|
| 0 | 0 | 0 | 53 | 11 | 73 |
| 0.1 | 150 | 0.4 | 34 | 13 | 72 |
| 1.0 | 150 | 4 | 2 | 3 | 78 |
| 1.2 | 40 | 18 | 8 | 3 | 72 |
| 3.0 | 100 | 18 | 5 | 1 | 81 |
| 4.5 | 150 | 18 | 2 | 0 | 81 |
| 4.0 | 40 | 60 | 3 | 1 | 80 |
| 4.0 | 300 | 8 | 2 | 1 | 79 |
| 6.0 | 200 | 18 | 2 | 0 | 82 |
| 12.5 | 150 | 50 | 2 | 0 | 82 |

The results show that at least about 1% current reversal is necessary to control the bismuth content of refined lead and that longer duration per reversal further improves the bismuth content. Substantially elimination of shorts with a current reversal of above 3% is obtained.

What we claim as our invention is:

1. In the process for the bipolar refinement of lead which includes: using impure lead bullion bipolar electrodes; an electrolyte containing lead fluosilicate, fluosilicic acid, and addition agents; a current density in the range of 100 to 600 A/m$^2$; an anode overvoltage maintained below the voltage at which impurities dissolve; an electrical current maintained at a value, related to the internal reistance of the cell, which will not cause the cell voltage to rise above the voltage at which impurities dissolve; periodical reversal of the polarity of the current applied to the cell; and recovering the refined lead from the bipolar electrodes, the improvements in combination which comprise:

(a) using an electrolyte containing at least about 85 g/l lead as lead fluosilicate and at most about 85 g/l lead fluosilicic acid so that the amount of dissolved lead as lead fluosilicate exceeds the amount of free fluosilicic acid in the electrolyte;

(b) applying a current to the cell at the beginning of the refining cycle to provide a current density in the cell of from about 240 A/m$^2$ to 450 A/m$^2$;

(c) applying the current to the cell for a refining cycle time of from about 72 hours to 130 hours;

(d) reversing the polarity of the current applied to the cell at a frequency of from about 4 to about 60 reversals per minute; and (e) limiting the duration of each reversal to a period chosen from within the range of from 40 to 300 milliseconds, such that the total period of current reversal is in the range of from 1% to 4.5% of the refining cycle time, whereby even dense, strong and readily stripped refined lead deposits are obtained on the bipolar electrodes; whereby the deposited lead has a low impurity content; whereby both nodular and dendritic growths of lead are avoided; and whereby electrical shorting in the cell is substantially reduced.

2. In the process for the bipolar refining of lead which includes using impure lead bullion electrodes containing bismuth; an electrolyte containing lead fluosilicate, fluosilicic acid, and addition agents; a current density in the range of from 100 A/m$^2$ to 600 A/m$^2$; an anode voltage maintained at about, but not in excess of, 200 mV; an electrical current maintained at the maximum value possible related to the change of interval resistance of the cell which will not cause the anode overvoltage to rise above about 200 mV; an increased electrode spacing between the end electrodes and their immediate neighbouring electrodes compared to the spacing of the remainder of the bipolar electrodes; periodical reversal of the polarity of the current applied to the cell; and recovering refined lead, the improvements in combination which comprise:

(a) using an electrolyte containing lead as lead fluosilicate in the range of from about 85 g/l to 120 g/l, and free fluosilicic acid in the range of from about 50 g/l to about 85 g/l, so that the amount of lead as lead fluosilicate exceeds the amount of free fluosilicic acid in the electrolyte;

(b) applying a current to the cell at the beginning of the refining cyle to provide a current density in the cell of from about 260 A/m$^2$ to about 400 A/m$^2$;

(c) applying current to the cell for a refining cycle time of from about 84 hours to about 120 hours;

(d) spacing the end electrodes in the cell from their immediate neighbours at a distance which is from 1.5 to 3.0 times the distance between the remainder of the bipolar electrodes;

(e) reversing the polarity of the current applied to the cell at a frequency of from about 8 to about 20 reversals per minute; and (f) limiting the duration of each reversal to a period chosen from within the range of from about 150 milliseconds to about 300 milliseconds, such that the total period of current reversal is in the range of from about 3% to about 4.5% of the refining cycle time;

whereby even, dense, strong and readily stripped refined lead deposits containing less than about 10 ppm bismuth are obtained; whereby nodular and dendritic growths of lead are avoided, and whereby electrical shorting in the cell is substantially reduced.

3. An improved process according to claim 1 or claim 2 wherein the electrolyte contains from 90 to 120 gm/l lead as lead fluosilicate.

4. An improved process according to claims 1 or 2 wherein the electrolyte contains from 60 to 70 g/l free fluosilicic acid.

* * * * *